US009107472B2

(12) United States Patent
Donzis et al.

(10) Patent No.: US 9,107,472 B2
(45) Date of Patent: Aug. 18, 2015

(54) ORTHOTIC FOOT DEVICE WITH REMOVABLE SUPPORT COMPONENTS AND METHOD OF MAKING SAME

(75) Inventors: Damian Donzis, San Diego, CA (US); Aimee Donzis, San Diego, CA (US)

(73) Assignee: ORTHOSOLE LIMITED, A Guernsey Limited Company, Guernsey, Channel Islands (GB)

( * ) Notice: Subject to any disclaimer, the term of this patent is extended or adjusted under 35 U.S.C. 154(b) by 473 days.

(21) Appl. No.: 13/436,774

(22) Filed: Mar. 30, 2012

(65) Prior Publication Data

US 2012/0246971 A1 Oct. 4, 2012

Related U.S. Application Data

(60) Provisional application No. 61/471,086, filed on Apr. 1, 2011.

(51) Int. Cl.
*A43B 13/38* (2006.01)
*A43B 7/14* (2006.01)

(52) U.S. Cl.
CPC ..... *A43B 7/1425* (2013.01); *A43B 7/145* (2013.01); *A43B 7/148* (2013.01); *A43B 7/149* (2013.01); *A43B 7/1445* (2013.01); *A43B 7/1465* (2013.01)

(58) Field of Classification Search
CPC .... A43B 7/1425; A43B 7/1445; A43B 7/149; A43B 7/1465; A43B 7/148; A43B 7/145
USPC ..... 36/43, 44, 71, 155, 140
See application file for complete search history.

(56) References Cited

U.S. PATENT DOCUMENTS

| | | | | |
|---|---|---|---|---|
| 3,084,695 | A * | 4/1963 | O'Donnell | 36/174 |
| 4,739,765 | A * | 4/1988 | Sydor et al. | 36/174 |
| 4,813,157 | A * | 3/1989 | Boisvert et al. | 36/44 |
| 4,841,648 | A | 6/1989 | Shaffer et al. | |
| 5,155,927 | A * | 10/1992 | Bates et al. | 36/28 |
| 6,000,147 | A * | 12/1999 | Kellerman | 36/44 |
| 6,205,685 | B1 * | 3/2001 | Kellerman | 36/44 |

(Continued)

FOREIGN PATENT DOCUMENTS

| | | |
|---|---|---|
| JP | H03-118003 | 12/1991 |
| KR | 1004111730000 | 12/2003 |
| WO | 2007021328 | 2/2007 |

OTHER PUBLICATIONS

South Korean Office Action dated May 7, 2014.

*Primary Examiner* — Jila M Mohandesi
(74) *Attorney, Agent, or Firm* — Jonathan L. Pettit, Esq.; Duckor Spradling Metzger & Wynne

(57) ABSTRACT

An embodiment of footwear having the orthotic foot device and method of making it is disclosed herein. The device provides support for the foot when used in footwear, in certain regions of the foot such as in the arch and metatarsal regions, in a manner that is very comfortable and yet supportive to the wearer. The embodiment of the orthotic foot device may provide at least one secure, but easily adjusted support component for a region of the foot such as the arch and metatarsal regions. The support component may be removably attached to a cushioned supportive footbed or chassis to provide an increased walking/running comfort and performance. It will become apparent to those skilled in the art that at least one of the support components may be fixedly or integrally attached to the footbed or chassis.

5 Claims, 11 Drawing Sheets

(56) References Cited

U.S. PATENT DOCUMENTS

| | | | | |
|---|---|---|---|---|
| 6,510,626 | B1 * | 1/2003 | Greenawalt | 36/43 |
| 6,990,756 | B1 * | 1/2006 | Johnson | 36/155 |
| 7,210,250 | B2 * | 5/2007 | Gallegos | 36/44 |
| 7,900,380 | B2 * | 3/2011 | Rich | 36/44 |
| 7,908,768 | B2 * | 3/2011 | Cheskin et al. | 36/44 |
| 8,250,783 | B2 * | 8/2012 | Luthi et al. | 36/44 |
| 8,453,346 | B2 * | 6/2013 | Steszyn et al. | 36/44 |
| 2003/0009915 | A1 * | 1/2003 | Bacon | 36/44 |
| 2004/0194344 | A1 * | 10/2004 | Tadin | 36/44 |
| 2006/0130364 | A1 * | 6/2006 | Greene et al. | 36/28 |
| 2011/0072685 | A1 * | 3/2011 | Gutowsky et al. | 36/44 |
| 2012/0272545 | A1 * | 11/2012 | Chenut | 36/43 |

* cited by examiner

ORTHOTIC FOOT DEVICE WITH REMOVABLE SUPPORT COMPONENTS AND METHOD OF MAKING SAME

RELATED APPLICATION

This application claims priority to U.S. provisional patent application, entitled ORTHOTIC FOOT DEVICE (INSOLE) WITH ADJUSTABLE METATARSAL AND ARCH SUPPORT, Application No. 61/471,086, filed Apr. 1, 2011, and to U.S. patent application, entitled ORTHOTIC FOOT DEVICE REMOVABLE SUPPORT COMPONENTS AND METHOD OF MAKING SAME, application Ser. No. 12/196,113, filed Aug. 21, 2008, both of which are incorporated herein by reference.

FIELD OF THE INVENTION

The present invention relates in general to footwear equipped with our orthotic device. It more particularly relates to footwear having an orthotic foot device with removable support components and method of making same.

BACKGROUND ART

There is no admission that the background art disclosed in this section legally constitutes prior art.

There have been many different types and kinds of orthotic devices for foot war. For example, reference may be made to U.S. Pat. Nos. 3,992,788; 4,603,698; 4,793,078; 4,841,648; 5,746,011; 6,105,283; 6,557,273; 6,804,902; 6,854,199; 7,107,704; 7,124,520; and 7,210,250; and U.S. Patent Application Publication Nos. 2004/0194344; 2007/0043582; 2007/0084084; and 2007/0180632.

There have been removable insoles for shoes, where the insoles employ removable support components. The support components are attached to a top or upper portion of the insole such that the support components are directly adjacent the bottom of the wearer's foot for supporting portions of the foot such as the arch. Such an arrangement may adversely affect the comfort and wearability of the insole.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF CERTAIN EMBODIMENTS OF THE INVENTION

Figure 1:
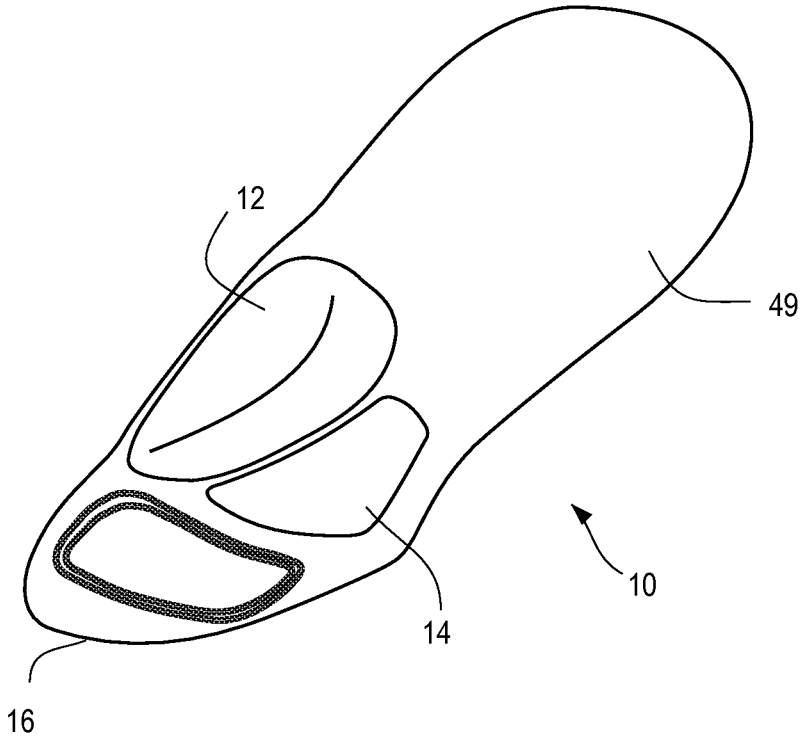
FIG. 1 is a pictorial view of an orthotic foot device for footwear shown in FIG. 12, with a pair of removable support components according to an embodiment of the present invention.
Figure 2:
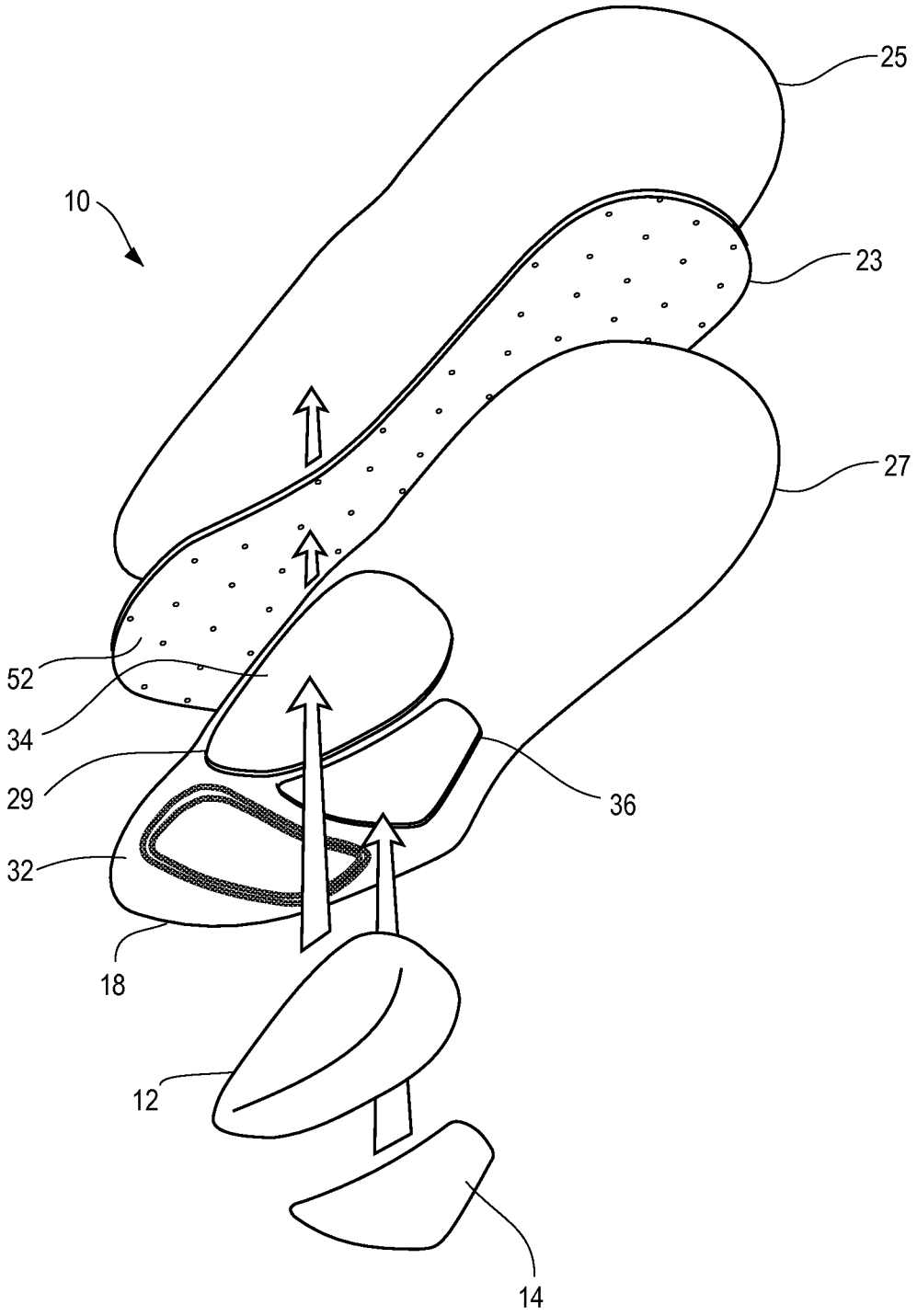
FIG. 2 is an exploded view of the orthotic foot device of FIG. 1.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

An embodiment, as shown in FIGS. 1-24, footwear including an insole having adjustable supports, and a means or a technique for attaching the insole to a midsole of the footwear.

According to an embodiment of the invention, footwear includes an insole having adjustable supports and having a toe portion and a heel portion, the heel portion being cup shaped and composed of the same material as the toe portion.

An embodiment of footwear having the orthotic foot device and method of making it is disclosed herein. The device provides support for the foot when used in footwear, in certain regions of the foot such as in the arch and metatarsal regions, in a manner that is very comfortable and yet supportive to the wearer. The embodiment of the orthotic foot device may provide at least one secure, but easily adjusted support component for a region of the foot such as the arch and metatarsal regions. The support component may be removably attached to a cushioned supportive footbed or chassis to provide an increased walking/running comfort and performance. It will become apparent to those skilled in the art that at least one of the support components may be fixedly or integrally attached to the footbed or chassis.

In accordance with certain embodiments of the present invention, there is provided footwear having an orthotic foot device for footwear such as a shoe having a heel and a toe. The orthotic foot device may include a flexible insole chassis adapted to extend substantially between the heel and the toe of the footwear and one or more support components attached adjacent to one another at a lower side of the chassis. The chassis may include a cushioned layer composed of conforming resilient material overlying the upper side of the chassis. The footwear may also include sandals, boots or others.

In accordance with another embodiment of the present invention, there is provided footwear having an orthotic foot device for footwear including a flexible insole chassis adapted to extend substantially between the heel and the toe of the footwear and a hard plastic heel portion having an extending portion that partially wraps upwardly along one side of the chassis for protecting the fifth metatarsal of the foot of the wearer. The chassis may include a cushioned layer composed of conforming resilient material.

In accordance with yet another embodiment of the present invention, there is provided footwear having an arch support component for an orthotic foot device including a dished piece composed of suitable flexible material. The dished piece may include a generally crescent shaped bottom portion and having a side portion integrally connected to and intersecting with the bottom portion at a curved ridge having a midpoint. The bottom portion may be configured to accommodate the foot arch. An attachment side of the member may include at least one attachment device adapted to removably connect to the insole. Alternatively, the arch support component may be fixedly or integrally attached to the insole.

In accordance with another embodiment of the present invention, there is provided footwear having a method of making an orthotic foot device for footwear having a heel and a toe. The method may include creating a flexible insole chassis adapted to extend substantially between the heel and the toe of the footwear, and attaching at least one support component to a bottom side of the cushioned layer.

Figure 11:
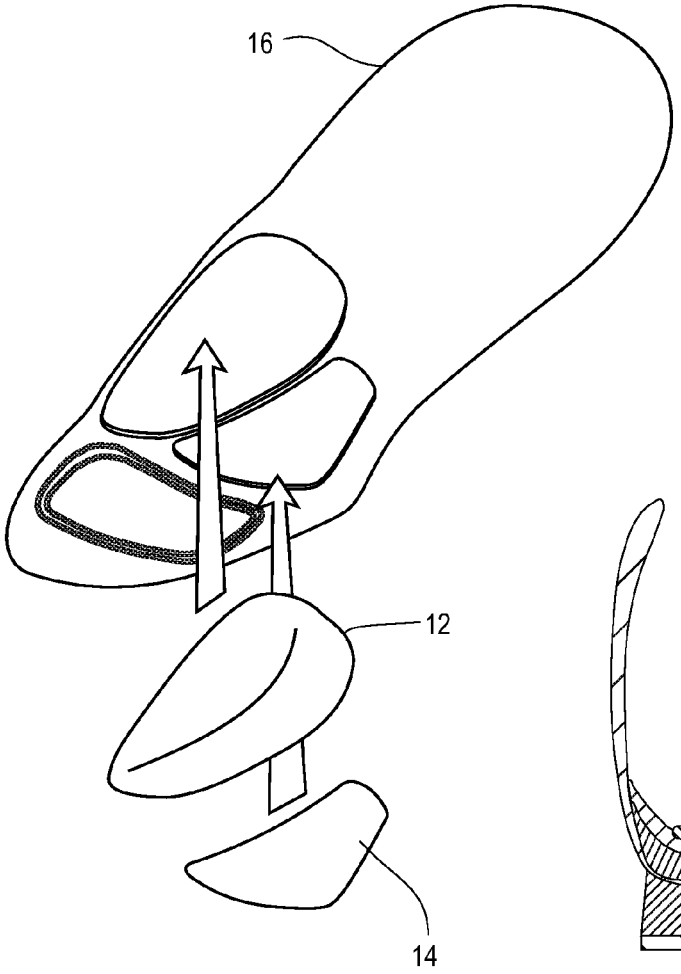
FIG. 11 is a pictorial view of the orthotic foot device of FIG. 1 showing the support components in the process of being attached in place.
Figure 12:
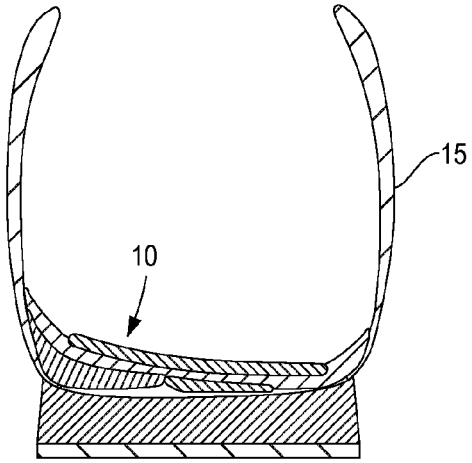
FIG. 12 is an enlarged sectional view of the orthotic foot device of FIG. 1 inserted within footwear such as a shoe.
Figure 13:
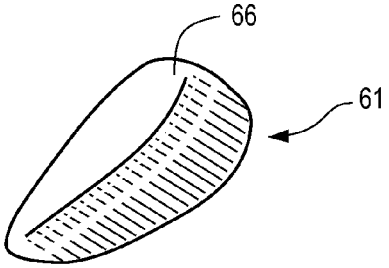
FIG. 13 is a pictorial view of the arch support for the orthotic foot device of FIG. 1.
Figure 14:
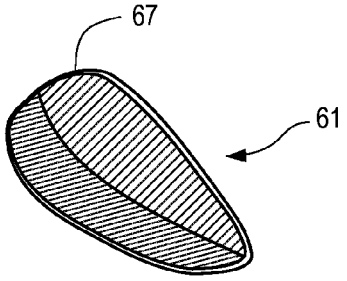
FIG. 14 is a bottom pictorial view of the arch support of FIG. 13.
Figure 15:
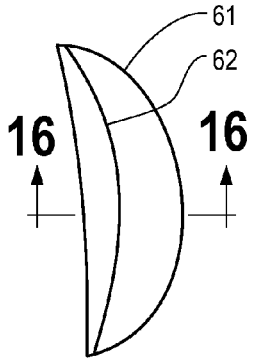
FIG. 15 is a top view of the arch support of FIG. 13, which provides light support.
Figure 17:
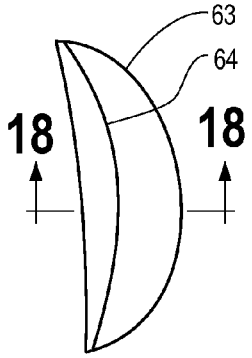
FIG. 17 is a top view of another arch support, which provides medium support for the orthotic foot device of FIG. 1.
Figure 19:
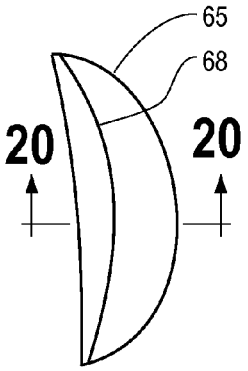
FIG. 19 is a top view of a further arch support, which provides firm support for the orthotic foot device of FIG. 1.
Figure 16:
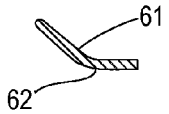
FIG. 16 is a sectional view of the arch support of FIG. 15 taken along lines 16-16 thereof.
Figure 18:
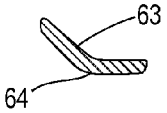
FIG. 18 is a sectional view of the arch support of FIG. 17 taken along lines 18-18 thereof.
Figure 20:
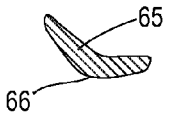
FIG. 20 is a sectional view of the arch support of FIG. 19 taken along lines 20-20 thereof.
Figure 21:
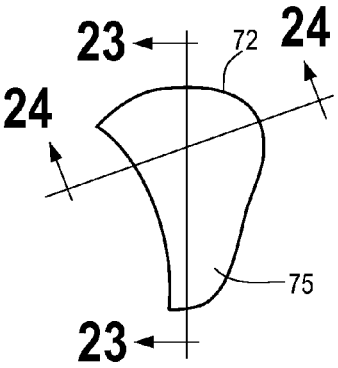
FIG. 21 is a top view of a metatarsal support, which provides light support for the orthotic foot device of FIG. 1.
Figure 22:
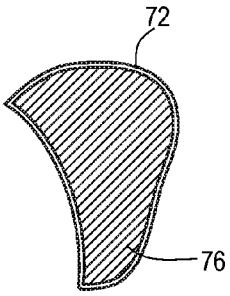
FIG. 22 is a bottom view of the metatarsal support of FIG. 21.
Figure 25:
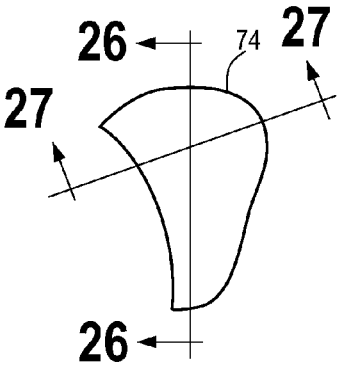
FIG. 25 is a top view of another metatarsal support, which provides medium support for the orthotic foot device of FIG. 1.
Figure 23:
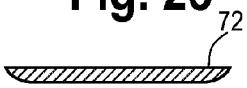
FIG. 23 is a sectional view of the metatarsal support of FIG. 21 taken along lines 23-23 thereof.
Figure 26:
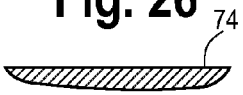
FIG. 26 is a sectional view of the metatarsal support of FIG. 25 taken on lines 26-26 thereof.
Figure 24:
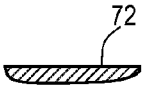
FIG. 24 is a sectional view of the metatarsal support of FIG. 21 taken along lines 24-24 thereof.
Figure 27:
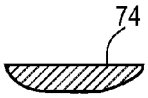
FIG. 27 is a sectional view of the metatarsal support of FIG. 25 taken on lines 27-27 thereof.
Figure 28:
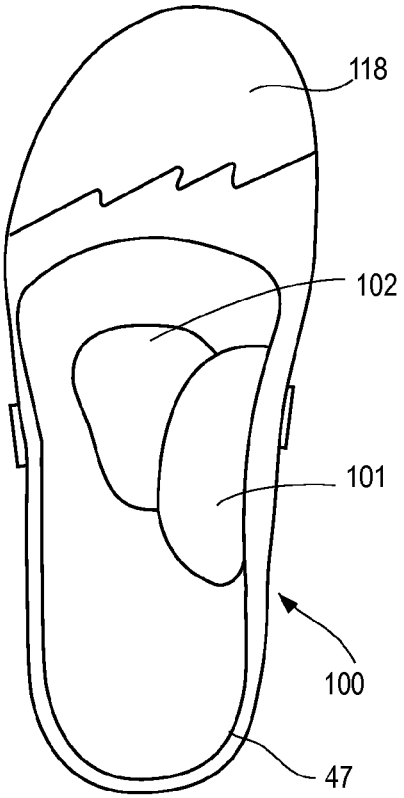
FIG. 28 is a partially broken away bottom view of a sandal with the ¾ insole, arch or metatarsal support pads attached.
Figure 29:
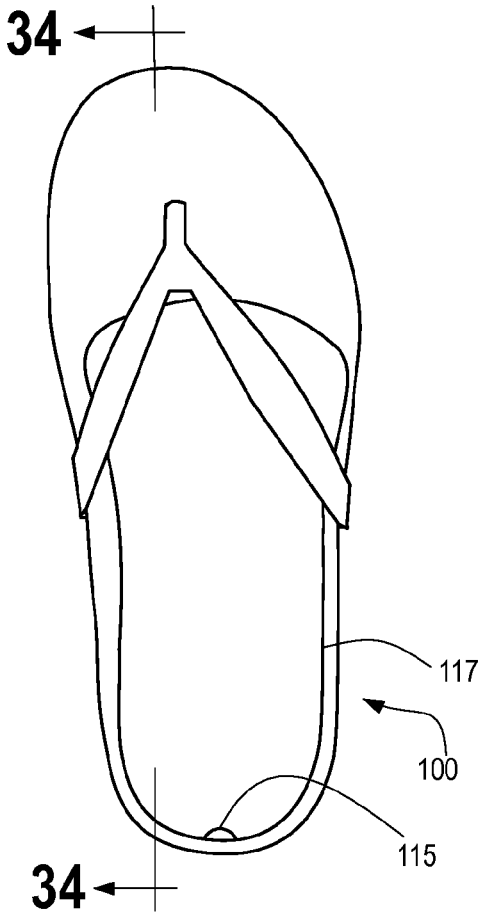
FIG. 29 is a top view of the sandal of FIG. 28 with the ¾ insole attached.
Figure 30:
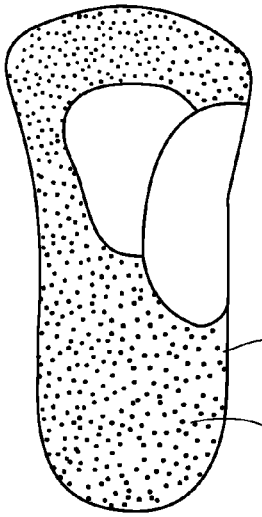
FIG. 30 is a top view of the ¾ insole of FIG. 28, illustrated being removed from its sandal.

Referring to FIGS. 1 through 10, an orthotic foot device 10 preferably in the form of an insole is shown as part of footwear such as a shoe 15 (FIG. 12) and may include a pair of removable support components, such as an arch support 12 and a metatarsal support 14, releasably attached to a footbed or insole chassis 16 that extends substantially the full length and breadth of a wearer's foot. Depending on the preference of the wearer, the arch support 12 and/or the metatarsal support 14 may be replaced with other similar arch supports and/or metatarsal supports which provide different amounts of support to accommodate the comfort and performance desired by the wearer as shown in FIG. 11. The orthotic foot device 10 may accommodate the desired comfort, protection, and support of the foot forms a part of the footwear such as a shoe 15 as shown in FIG. 12.

The chassis 16 is elongated and may include a main structural layer 18 that extends substantially the full length and breadth of the foot, a heel layer 21 permanently attached to the bottom of the main structural layer 18, a cushioned layer 23 permanently attached to the top of the main structural layer 18, and a fabric layer 25 permanently attached to the top of the cushioned layer 23. The main structural layer 18 may include a cupped heel portion 27, a middle narrowed attachment portion 29, and an enlarged rounded toe portion 32. The main structural layer 18 may be at least partially composed of a flexible material, such as EVA or polyurethane and thus is entirely composed of the same material.

The recessed or cupped heel portion 27 of the main structural layer 18 may be shaped or configured to receive the heel of the foot and partially wrapping around the side of the heel for support and protection of the heel.

The middle attachment portion 29 may be shaped to partially wrap around the side of the foot adjacent the arch of the foot and is recessed. The portion 29 includes an arch attachment region 34 adapted for removably receiving and attaching to the arch support 12, and a metatarsal attachment region 36 adapted for removably receiving and attaching the metatarsal support 14. The attachment regions 34 and 36 may include a plurality of loops 38 and 39, such as Velcro, or other removable connecting feature to interlock with a corresponding feature such as hooks on the supports 12 and 14, respectively.

The toe portion 32 may include a flexible, resilient area 41 to provide cushioning support to the toes and pad of the foot. The resilient area 41 may include a textured or roughened design to reduce slippage of the orthotic foot device 10 when placed in a shoe.

The heel layer 21 may include a hard plastic heel member 43 that may be shaped to correspond to the shape of the cupped heel portion 27 of the main structural layer 18 and a hard plastic extending leg 45 that extends along one side of the main structural layer 18 into the middle attachment portion 29. One side of the extend leg may be shaped in a complementary manner to edges of the support components 12, 14. The heel member 43 may protect the heel and lower portions of the side of the heel, while the extending leg 45 may protect the fifth metatarsal. The heel member 43 may also include an opening 47 in which a cushioned pad 49 may be inserted and permanently attached to the bottom of heel portion 27 of the main structural layer 18 to cushion the impact on the heel of the foot of the wearer. The cushioned pad 49 may be composed of a flexible resilient material such as a urethane gel or other suitable material to cushion.

The cushioned layer 23 may be permanently attached to the top or opposite side of the main structural layer 18 as is attached the heel layer 21. The cushioned layer 23 may be shaped substantially the same as the main structural layer 18, except that the cushioned layer 23 may not cover the areas of the main structural layer 18 that partially wrap upwardly around the side of the foot. The cushioned layer 23 may include a plurality of holes 52 to prevent the introduction of air bubbles into the orthotic foot device 10 during the fastening of the fabric layer 25 to the cushioned layer 23 by suitable means such as the application of a suitable adhesive material. The cushioned layer 23 may be composed of a conforming flexible resilient material having a slow rebound characteristic, such as a urethane foam material sold under the registered trademark Poron® by Rogers Corporation or Rogers, Conn., or similar material, to provide added comfort and protection of the foot, and to reduce the sharpness in the edges of the support components 12, 14. The cushioned layer 23 may conform closely to the shape of the foot to fill in spaces or gaps, such as at the arch and around the toes, and to keep the entire foot in contact with the orthotic foot device 10. Poron is a performance urethane material which provides excellent shock absorption when walking, running, or performing other activities to help prevent foot fatigue. The material of the cushioned layer 23 compresses and conforms to the contours of the foot when weight is put on the foot, but immediately retains its original shape once the weight is removed. The thickness of the cushioned layer may be between the range of about 0.5 mm and about 10 mm. More preferably, the thickness may be about 3 mm. The wearer of the orthotic foot device 10 within the footwear such as the shoe 15 would select a chassis 16 that includes a cushioned layer 23 having their desired thickness as a matter of personal preference and comfort.

The fabric layer 25 of the chassis 16 may completely cover the cushioned layer 23 and the upwardly wrapping portions of the main structural layer 18. The fabric layer 25 may be composed of a thin natural or synthetic material, such as nylon or polyester, which absorbs moisture from the foot and helps to prevent the foot from sticking to the orthotic foot device 10. The fabric layer 25 may be treated with an antimicrobial agent to avoid foot odor/smelly shoes.

Figure 3:
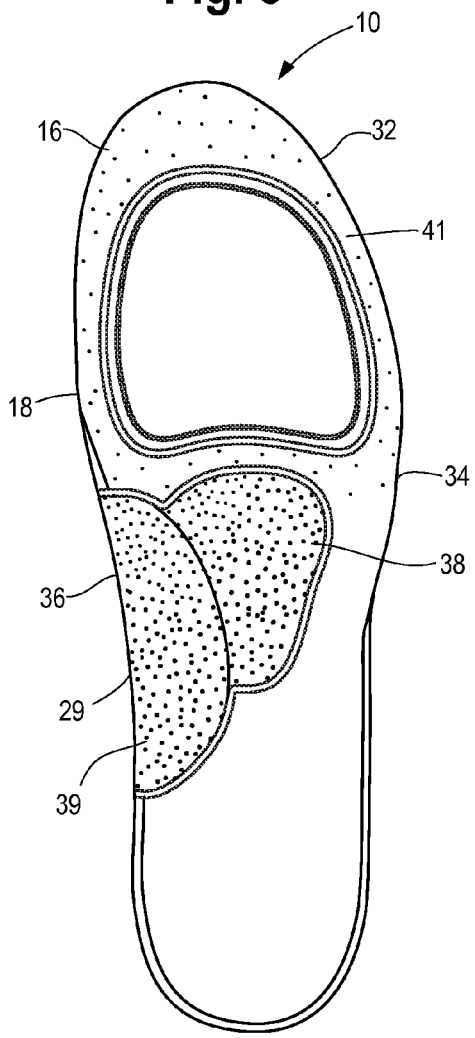
FIG. 3 is an enlarged view of the orthotic foot device of FIG. 1 with the support components removed.
Figure 4:
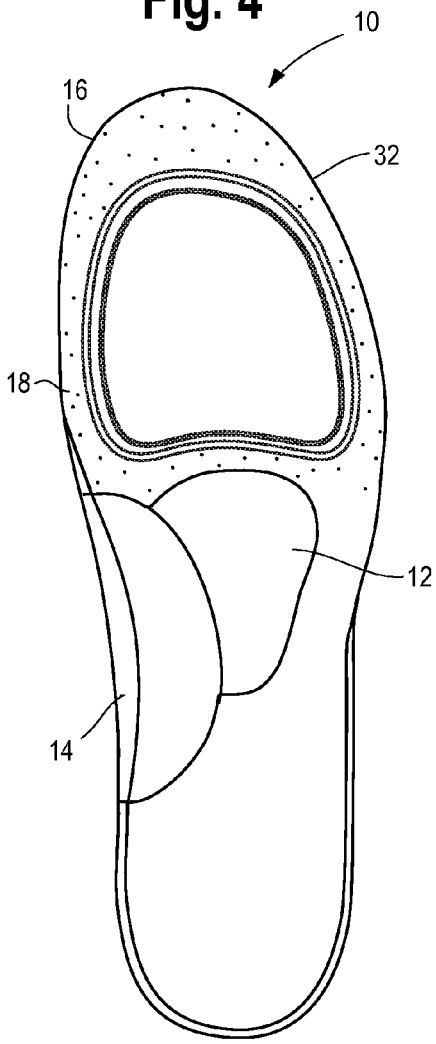
FIG. 4 is an enlarged view of the orthotic foot device of FIG. 1 with the support components attached.
Figure 5:
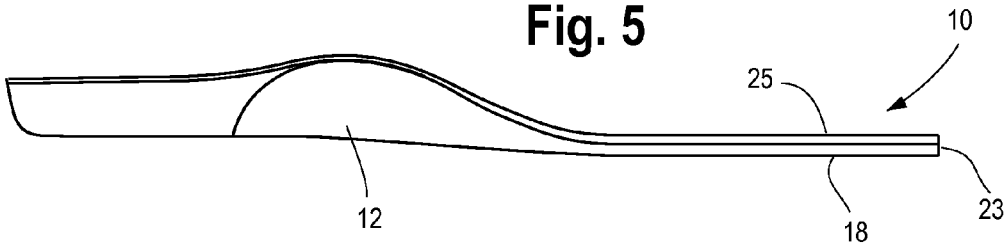
FIGS. 5 and 6 are enlarged side elevational views of the orthotic foot device of FIG. 1.
Figure 6:
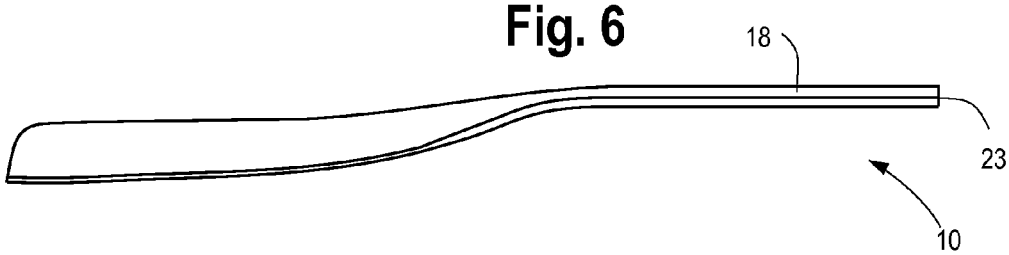
Figure 7:
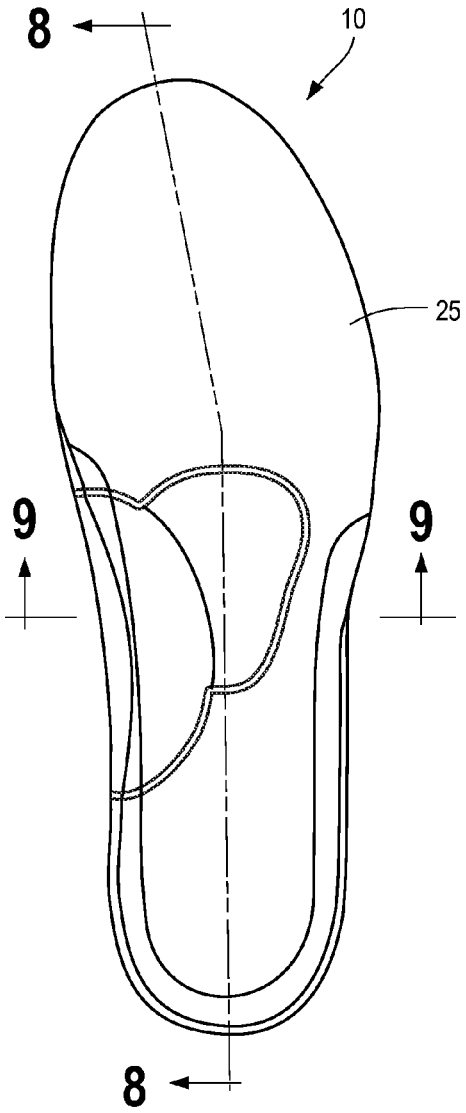
FIG. 7 is an enlarged top view of the orthotic foot device of FIG. 1.
Figure 9:
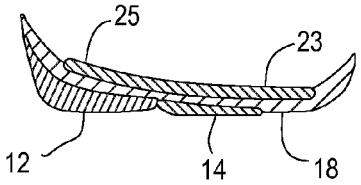
FIG. 9 is a sectional view of the orthotic foot device of FIG. 7 taken along lines 9-9 thereof.
Figure 8:
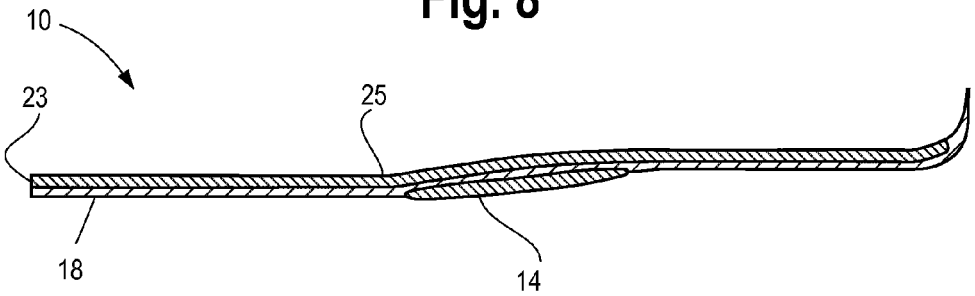
FIG. 8 is a sectional view of the orthotic foot device of FIG. 7 taken along lines 8-8 thereof.
Figure 10:
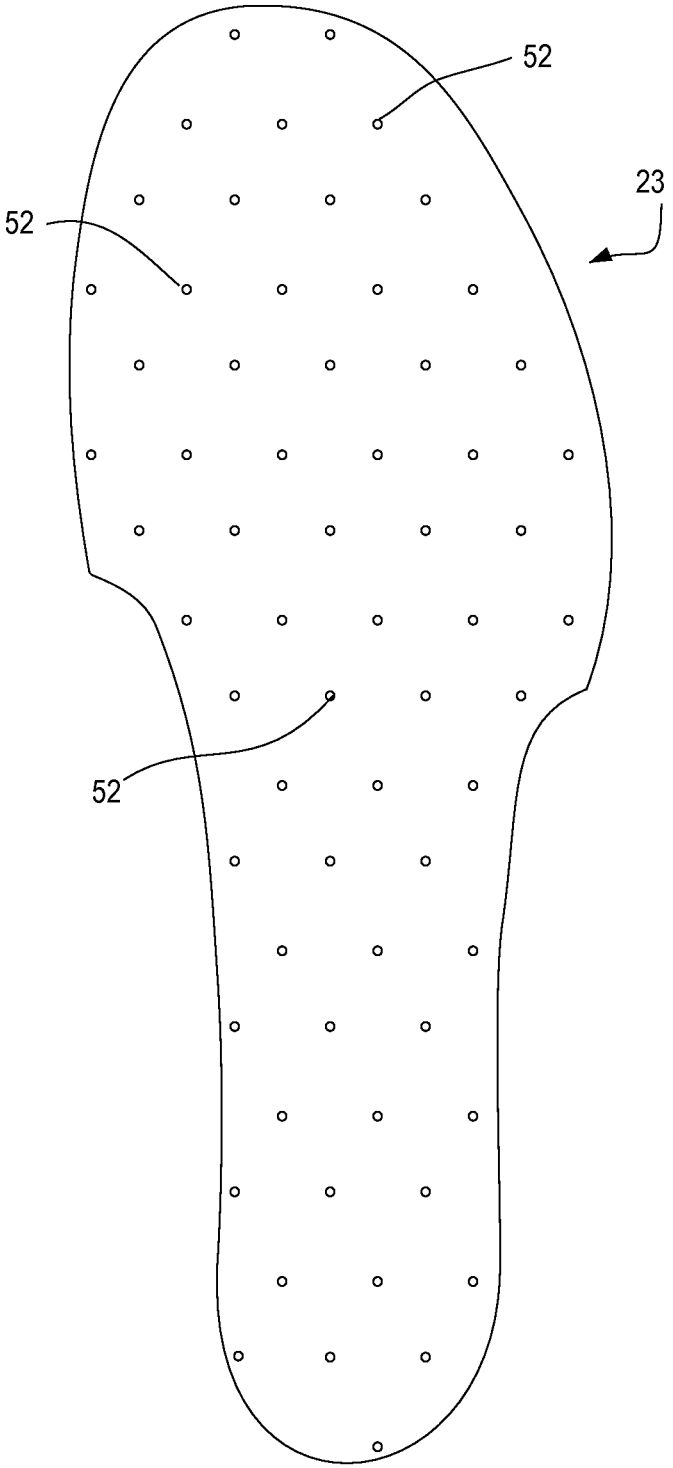
FIG. 10 is an enlarged top view of the cushion layer portion of the orthotic foot device of FIG. 2.

Referring now to FIGS. 13 through 20, a plurality of arch supports are shown that provide different amounts of arch support; a light arch support 61, a medium arch support 63, and a firm arch support 65. Each arch support may include a dished piece 66 made of a flexible material, such as EVA, urethane, or gel, and a fastener such as a plurality of hooks 67, such as Velcro, or other removable connecting feature on one side of the arch support for interlocking with the loops 38 of the attachment region 34 (FIG. 3). The thickness of the arch support may determine the amount of support and flexibility provided by the arch support. The light arch support 61 may include the thinnest dished shape or configuration having a C-shaped ridge 62 providing the lowest level of arch support and the most flexibility. The medium arch support 63 may include an intermediate thickness, which is dished shaped, having a C-shaped ridge 64 providing an intermediate level of arch support and less flexibility than the light arch support 61. The firm arch support 65 may include the thickest dished shape, having a C-shaped ridge 68 providing the greatest level of arch support and the least flexibility.

Referring now to FIGS. 21-27, a pair of metatarsal supports is shown that provide two different amounts of metatarsal support for the wearer. A light metatarsal support 72 and a medium metatarsal support 74 may be provided, but it should be understood that a different number may also be provided. Each metatarsal support may include a tear drop shaped piece 75 made of a flexible material, such as EVA, urethane, or gel, and a plurality of hooks 76 (FIG. 22), such as Velcro, or other removable connecting feature on one side of the metatarsal support for interlocking with the loops 39 of the attachment region 36 (FIG. 3). One portion of the tear drop shaped support may include a complementary shape to a portion of the arch support to allow metatarsal support and the arch support to be attached directly adjacent to one another. The thickness of the metatarsal support may determine the amount of support and flexibility provided by the metatarsal support. The light metatarsal support 72 may include the thinnest irregularly shaped piece providing the lowest level of metatarsal support and the most flexibility. The metatarsal support 74 may include a thicker dished piece providing a greater level of metatarsal support and less flexibility than the light metatarsal support 72.

A method of making the removable orthotic foot device for footwear such as the shoe 15 (FIG. 12) may include the following steps. First, the insole chassis may be made, by creating a main structural layer, as described previously, that extends from the heel to the toe of a shoe using a suitable material. Next, the hard plastic heel portion having an opening may be fixedly attached to the cupped portion on the bottom of the main structural layer by a suitable fastener such as by applying a suitable adhesive. The cushioned pad may then be permanently attached within the opening of the heel portion to the main structural layer, also by a suitable fastener such as an adhesive.

Next, the material having loops, such as Velcro, or other removable connecting features may be attached to the attachment regions for the support components on the bottom of the main structural layer. The cushioned layer made of the conforming slow rebound resilient flexible material and substantially the same size as the main structural layer may then be attached or formed on the top of the main structural layer. The fabric layer may then be attached to the top of the cushioned layer and the upwardly extending portions of the main structural layer by a fastener such as a suitable adhesive. Lastly, the plurality of support components having different levels of support may be made using a suitable flexible material and including a portion of material having hooks, such as Velcro, or other complementary removable fastening feature attached to the underside of each support component for interlocking with the material having loops attached to the insole chassis. The support components may be made by a suitable process such as injection molding or other process.

The size of the insole chassis and the support components may vary due to the size and type of the shoe they are to be utilized within.

Referring to the drawings, a footwear 100 of FIGS. 28-37 includes a detachable insole 117 with adjustable components such as an adjustable support or pad 106 attached to a midsole of the footwear 100. The footwear 100 includes a cavity 112 in the midsole for receiving the insole 117 in a removable manner to permit an interchange of the adjustable components. The insole 117 is a ¾ insole, but otherwise is similar to the insole 10.

Considering now FIGS. 28-37, there is shown footwear in the form of a sandal 100, which is constructed in accordance with an embodiment of the invention, and which includes removable supports similar to the insole 10, to provide for a full spectrum (zero to full) of arch and metatarsal support adjustment.

The sandal foot device 100 includes the supportive insole 117 that extends about ¾ the length of the foot, or other part thereof, and provides interchangeable supports for the arch and metatarsal regions in a manner similar to the insole 10. The material comprising the footbed also permits the complete collapsing of any preformed supportive surfaces, particularly found in the arch and metatarsal regions. While a sandal is shown and described, other types and kinds of footwear such as boot and shoe wear may also incorporate the principles of the present invention.

In broad terms, a preferred embodiment of the footwear 100 may include three arch supports, light 104, medium 105 and firm 106; two metatarsal supports light 107 and medium 108, the ¾ insole 117 and a sandal chassis or sandal sole 118. The light arch support preferably being 3 mm high 104, the medium arch support preferably being 6 mm high 105, the firm arch support preferably being 9 mm high 106, the light metatarsal support preferably being 4 mm high 107, and the medium metatarsal support preferably being 7 mm high 108. The arch and metatarsal supports fit in a pocket 101 (FIG. 33) of the insole 117.

Each support pad provides a different level of support. The arch support may attach to the ¾ insole through Velcro 109. The metatarsal support may attach to the ¾ insole through Velcro 120. One side of each support may be covered with Velcro 119.

Figure 31:
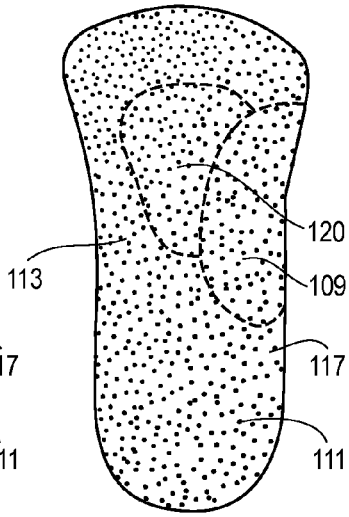
FIG. 31 is a bottom view of the ¾ insole of FIG. 30 with an arch and metatarsal pad attached.
Figure 32:
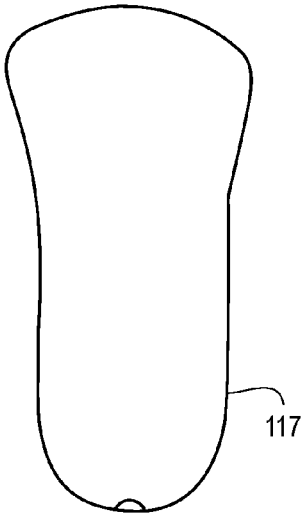
FIG. 32 is a bottom view of the ¾ insole of FIG. 31 without pads attached.
Figure 33:
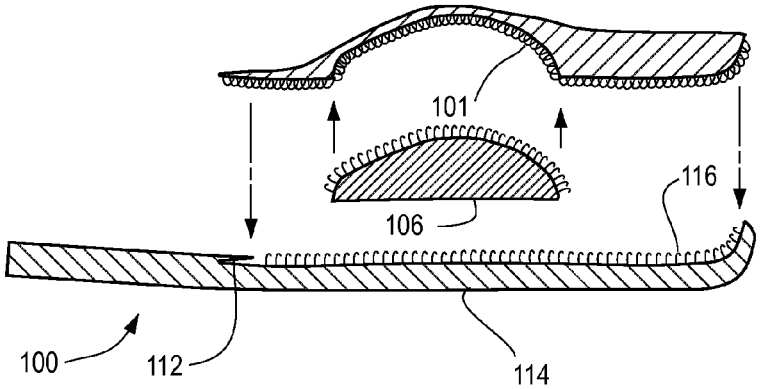
FIG. 33 is an exploded section view taken substantially along line A1-A2 of FIG. 31 of the sandal sole showing a sequence where the arch and metatarsal pads are being attached using Velcro to the bottom of the ¾ insole and then the ¾ insole (with arch and metatarsal pads attached) being attached to the top of sandal sole also by Velcro.
Figure 34:
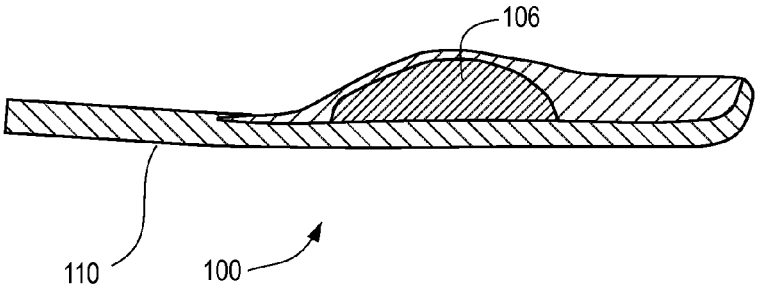
FIG. 34 is an assembled section view taken substantially along line A1-A2 from FIG. 31 of the sandal sole and the ¾ insole with pads attached to the sandal sole.
Figure 35A:
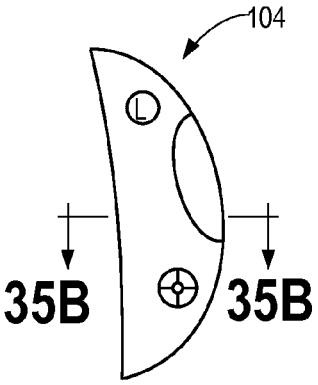
FIGS. 35A, 35C and 35E are top views and section view FIGS. 35B, 35D and 35F of the arch supports.
Figure 35C:
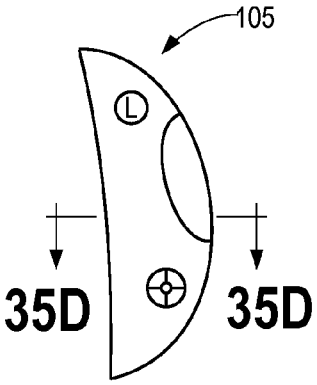
Figure 35E:
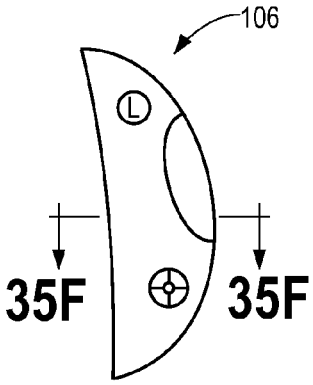
Figure 35B:
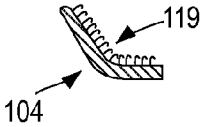
Figure 35D:
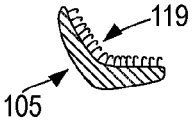
Figure 35F:
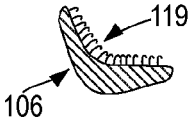
Figure 36A:
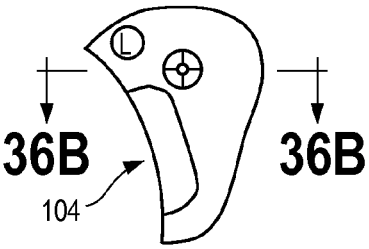
FIGS. 36A and 36C are top views and section view FIGS. 36B and 36D of the metatarsal supports.
Figure 36C:
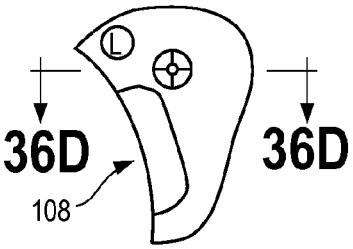
Figure 36B:
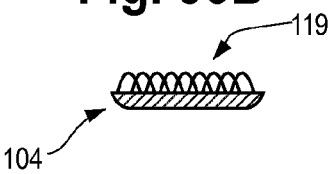
Figure 36D:
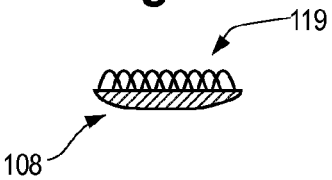
Figure 37:
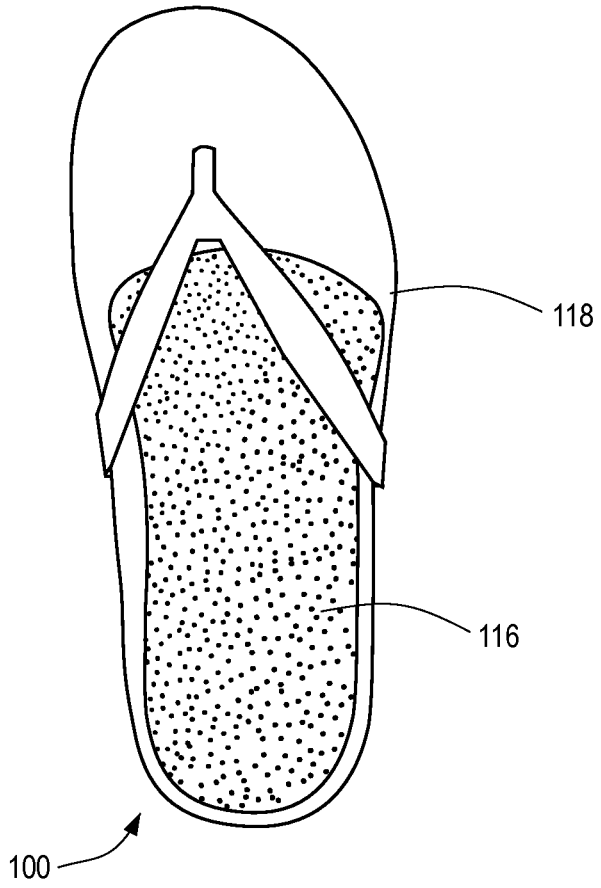
FIG. 37 is a top view of the sandal without the ¾ insole attached.

Other attachment means (not shown) may also be used. The ¾ insole underside surface is covered with Velcro 111 including the arch and metatarsal areas. As shown in FIG. 31, dotted lines indicate the arch and metatarsal areas of the insole underside surface from the rest of the underside surface 113. Velcro may allow the ¾ insole 117 to be attached to the sandal's sole 118.

Once a metatarsal and an arch support are attached to the ¾ insole 117, the insole and supports may be attached releasably to the sandal sole 110. The sandal sole 118 may be shaped in a manner that allows the ¾ insole 117, with supports attached, to fit tightly and stay in place 114. The top side of the sandal sole may have an area covered with Velcro 116 in the pocket 101 of the ¾ insole fits 116. The sandal sole 118 may also include a locking section of the compartment 112 of sufficient size and shape to help hold the insole 117 securely in place. In this regard, the compartment 112 (FIG. 33) may be configured in the shape of the insole 117 to hold it releasably in place by Velcro 116. The marginal edges have an undercut to secure the insole 117 in position.

In use, the preferred embodiment of the invention can be with any combination of arch and metatarsal supports, in place or removed. All supports can be removed by hand with no additional tools necessary. The ¾ insole may be removed from the sandal sole by hand with no additional tools necessary. A tab may be provided to lift off the ¾ insole from the sandal sole helps to separate both components 115.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the inventive concept. Thus, the following drawings and description are to be regarded as illustrative in nature and not restrictive.

Words such as "about," "approximately" or other such words as used herein shall be defined to mean a tolerance of plus or minus 20 percent.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A footwear, comprising:

a sole having a cavity in the shape of an insole and for receiving an insole;

the insole having an underside surface; the underside surface of the insole removably attached to the sole;

an arch support removably attached to the underside surface of the insole and adapted to support a foot of a wearer;

a metatarsal support removably attached to the underside surface of the insole directly adjacent to the arch support and adapted to support a foot of a wearer;

the insole having a pocket on the underside surface including both an arch support receiving region configured in the shape of the arch support and a metatarsal support receiving region configured in the shape of the metatarsal support disposed directly adjacent to one another to form a single recessed region for both supports; the arch support and the metatarsal support being received within the pocket;

one portion of the arch support and one portion of the metatarsal support being complementary shaped to enable the supports to directly fit together within the pocket directly adjacent to one another;

wherein the arch support and the metatarsal support are adapted to provide comfort to a foot of a wearer.

2. The footwear of claim 1, wherein the insole extends approximately ¾ of the length between a heel portion and a toe portion of the footwear.

3. The footwear of claim 1, wherein the insole includes a heel portion, the heel portion being cup shaped.

4. The footwear of claim 1, wherein the cavity includes a margin edge including an undercut.

5. A method of making a footwear, comprising the steps of:

providing a sole having a cavity configured in the shape of an insole and for receiving an insole;

the insole including an underside surface comprising a pocket on the underside surface including both an arch support receiving region configured in the shape of an arch support and a metatarsal support receiving region configured in the shape of a metatarsal support disposed directly adjacent to one another to form a single recessed region for both supports;

removably attaching an arch support to the pocket of the insole;

removably attaching a metatarsal support to the pocket of the insole directly adjacent to the arch support;

fitting together complementary portions of the arch support and the metatarsal support within the pocket directly adjacent to one another;

removably attaching the underside surface of the insole to the sole.

* * * * *